US010584551B2

(12) United States Patent
Hradecky

(10) Patent No.: US 10,584,551 B2
(45) Date of Patent: Mar. 10, 2020

(54) DOWNHOLE IMPACT APPARATUS

(71) Applicant: Impact Selector International, LLC, Houma, LA (US)

(72) Inventor: Jason Allen Hradecky, Heath, TX (US)

(73) Assignee: Impact Selector International, LLC, Houma, LA (US)

( * ) Notice: Subject to any disclaimer, the term of this patent is extended or adjusted under 35 U.S.C. 154(b) by 184 days.

(21) Appl. No.: 15/576,463

(22) PCT Filed: May 20, 2016

(86) PCT No.: PCT/US2016/033473
§ 371 (c)(1),
(2) Date: Nov. 22, 2017

(87) PCT Pub. No.: WO2016/191261
PCT Pub. Date: Dec. 1, 2016

(65) Prior Publication Data

US 2018/0156003 A1 Jun. 7, 2018

Related U.S. Application Data

(60) Provisional application No. 62/165,355, filed on May 22, 2015.

(51) Int. Cl.
*E21B 31/107* (2006.01)

(52) U.S. Cl.
CPC ..... *E21B 31/107* (2013.01)

(58) Field of Classification Search
CPC ..... E21B 31/00; E21B 31/107; E21B 31/113; E21B 31/1135
See application file for complete search history.

(56) References Cited

U.S. PATENT DOCUMENTS

2005/0224226 A1* 10/2005 Read, Jr. ..... E21B 17/06 166/217
2007/0151732 A1* 7/2007 Clemens ..... E21B 31/107 166/301

FOREIGN PATENT DOCUMENTS

WO 2016191261 A1 12/2016

OTHER PUBLICATIONS

PCT International Search Report and the Written Opinion of the International Searching Authority for PCT/US2016/033473 dated Sep. 26, 2016, 13 pages.

* cited by examiner

*Primary Examiner* — David Carroll
(74) *Attorney, Agent, or Firm* — Boisbrun Hofman, PLLC

(57) ABSTRACT

An impact tool for coupling between opposing first and second portions of a downhole tool. The impact tool may include a housing having opposing first and second ends, a first shaft extending from within the housing at the first end of the housing, a second shaft extending from within the housing at the second end of the housing, an energy storing member disposed within the housing, and a latching mechanism operable to selectively permit relative motion between the housing and the second shaft to release energy stored in the energy storing member to impart an impact to the downhole tool string.

20 Claims, 5 Drawing Sheets

DOWNHOLE IMPACT APPARATUS

CROSS-REFERENCE TO RELATED APPLICATIONS

This application is a national stage of, and claims priority to and the benefit of, International Patent Application No. PCT/US2016/033473, entitled "Downhole Impact Apparatus," filed May 20, 2016, which claims priority to and the benefit of U.S. Provisional Patent Application No. 62/165,355, entitled "Downhole Impact Apparatus," filed May 22, 2015. The entire disclosures of both applications are hereby incorporated herein by reference.

BACKGROUND OF THE DISCLOSURE

A number of well intervention applications are required when completing wells with formation isolation valves. Such valves are typically installed during completion operations and mechanically closed to prevent fluid loss when tubing and/or other tools are pulled through them. The valves may be re-opened remotely by applying a sequence of pressure pulses. However, in a subset of installations, ranging between about five percent and about ten percent, the valve opening mechanism may become stuck, requiring the valve to be shifted mechanically via a downhole tool.

A stuck valve may be mechanically shifted using coiled tubing. The coiled tubing may be used to clean out well debris and residual fracturing sand or particles prior to shifting the valve. However, the cost, footprint, and operational time required for deployment of a coiled tubing unit and other related equipment makes this option undesirable.

Accordingly, mechanical valve shifting operations may be performed using a downhole stroker tool run via a wireline. Prior to running the stroker tool, a clean-up run is often conducted utilizing a milling tool fitted with a brush bit and assisted with a debris collection tool. Although mechanical valve shifting is often successfully accomplished with the stroker tool, the push/pull forces generated by stroker tools are limited. For example, a 2⅛ inch stroker tool may generate a maximum push/pull force of about 12,000 pounds. Other stroker tools may generate about 24,000 pounds of force. Often times, however, static friction caused by sand or other contaminants may prevent the formation isolation valve, or another downhole valve or tool installed within the wellbore, from shifting or being dislodged with the stroker tool. Under such conditions, push/pull forces exceeding operational limits of the stroker tools are necessary to shift the valves or other downhole tools that are stuck.

BRIEF DESCRIPTION OF THE DRAWINGS

The present disclosure is best understood from the following detailed description when read with the accompanying figures. It is emphasized that, in accordance with the standard practice in the industry, various features are not drawn to scale. In fact, the dimensions of the various features may be arbitrarily increased or reduced for clarity of discussion.

DETAILED DESCRIPTION

Figure 1:
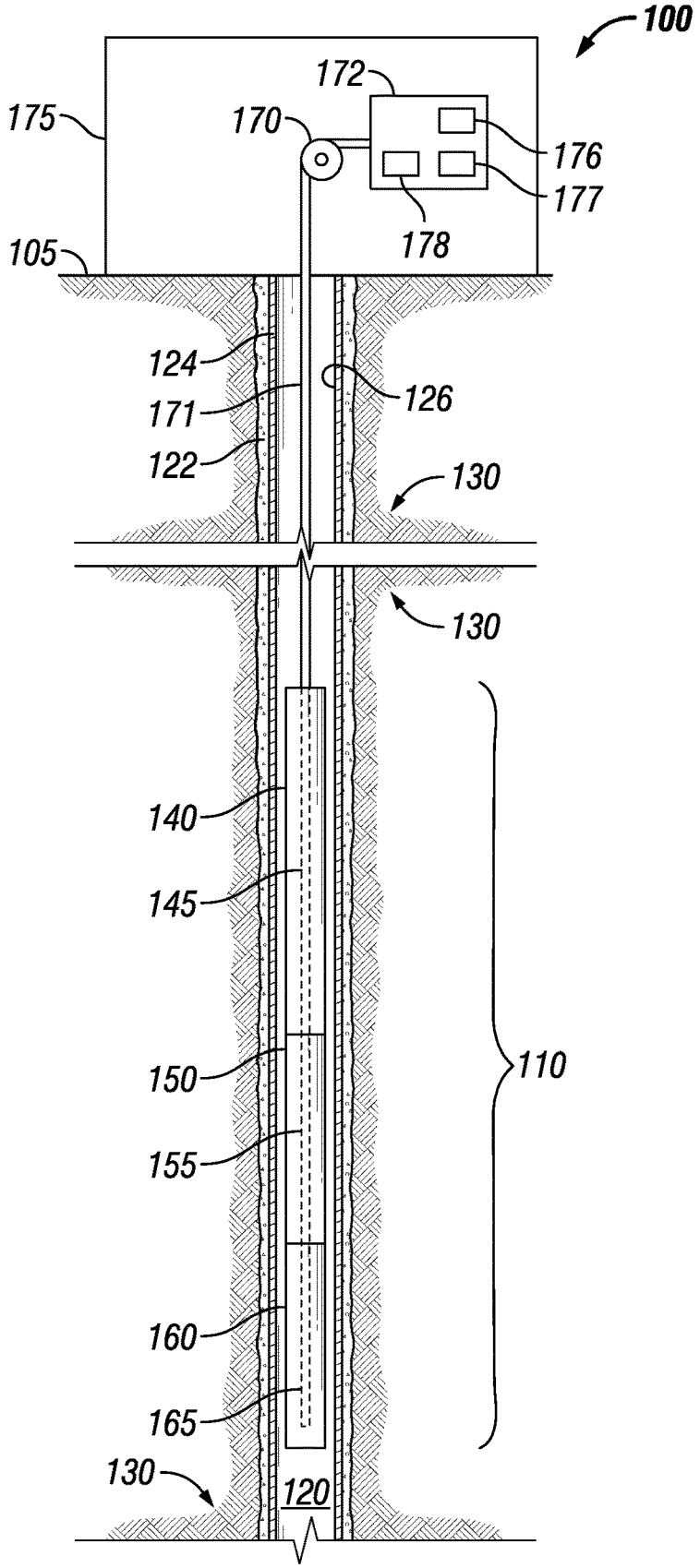
FIG. 1 is a schematic view of at least a portion of an example implementation of apparatus according to one or more aspects of the present disclosure.

It is to be understood that the following disclosure provides many different embodiments, or examples, for implementing different features of various embodiments. Specific examples of components and arrangements are described below to simplify the present disclosure. These are, of course, merely examples and are not intended to be limiting. In addition, the present disclosure may repeat reference numerals and/or letters in the various examples. This repetition is for simplicity and clarity, and does not in itself dictate a relationship between the various embodiments and/or configurations discussed. Moreover, the formation of a first feature over or on a second feature in the description that follows, may include embodiments in which the first and second features are formed in direct contact, and may also include embodiments in which additional features may be formed interposing the first and second features, such that the first and second features may not be in direct contact.

FIG. 1 is a schematic view of at least a portion of a wellsite system 100 according to one or more aspects of the present disclosure. The wellsite system 100 may comprise a tool string 110 suspended within a wellbore 120 that extends from a wellsite surface 105 into one or more subterranean formations 130. The wellbore 120 is depicted as being a cased-hole implementation comprising a casing 124 secured by cement 122. However, one or more aspects of the present disclosure are also applicable to and/or readily adaptable for utilizing in open-hole implementations lacking the casing 124 and cement 122.

The tool string 110 may be suspended within the wellbore 120 via conveyance means 171 operably coupled with a tensioning device 170 and/or other surface equipment 175 disposed at the wellsite surface 105, including a power and control system 172. The tensioning device 170 may be operable to apply an adjustable tensile force to the tool string 110 via the conveyance means 171. The tensioning device 170 may be, comprise, or form at least a portion of a crane, a winch, a drawworks, a top drive, and/or another lifting device coupled to the tool string 110 by the conveyance means 171. The conveyance means 171 may be or comprise a wireline, a slickline, an e-line, coiled tubing, drill pipe, production tubing, and/or other conveyance means, and may comprise and/or be operable in conjunction with means for communication between the tool string 110, the tensioning device 170, and/or one or more other portions of the surface equipment 175, including the power and control system 172. The conveyance means 171 may also comprise a multi-conductor wireline and/or other electrical conductors extending between the tool string 110 and the surface equipment 175. The power and control system 172 may include a source of electrical power 176, a memory device 177, and a controller 178 operable to receive and process electrical signals from the tool string 110 and/or commands from a surface operator.

The tool string 110 may comprise an uphole or upper portion 140, a downhole or lower portion 160, and an impact jar or tool 150 coupled between the upper portion 140 and the lower portion 160. The upper and lower portions 140, 160 of the tool string 110 may each be or comprise one or more downhole tools, modules, and/or other apparatus operable in wireline, while-drilling, coiled tubing, completion, production, and/or other implementations. The upper portion 140 of the tool string 110 may comprise at least one electrical conductor 145 in electrical communication with at least one component of the surface equipment 175. The lower portion 160 of the tool string 110 may also comprise at least one electrical conductor 165 in electrical communication with at least one component of the surface equipment 175, wherein the at least one electrical conductor 145 and the at least one electrical conductor 165 may be in electrical communication via at least one electrical conductor 155 of the impact tool 150. Thus, the electrical conductors 145, 155, 165 may connect with and/or form a portion of the conveyance means 171, and may include various electrical connectors and/or interfaces along such path.

Each of the electrical conductors 145, 155, 165 may comprise a plurality of individual conductors, such as may facilitate electrical communication between one or more of the upper portion 140, the impact tool 150, and the lower portion 160 and one or more component of the surface equipment 175, such as the power and control system 172. For example, the conveyance means 171 and the electrical conductors 145, 155, 165 may be operable to transmit and/or receive electrical power, data, and/or control signals between the power and control system 172 and one or more of the upper portion 140, the impact tool 150, and the lower portion 160. The electrical conductors 145, 155, 165 may further facilitate electrical communication between two or more of the upper portion 140, the impact tool 150, and the lower portion 160. Each of the upper portion 140, the lower portion 160, the impact tool 150, and/or portions thereof may comprise one or more electrical connectors (not shown), such as may be operable to electrically connect the electrical conductors 145, 155, 165 extending therebetween.

Although depicted as single members, the upper and lower portions 140, 160 of the tool string 110 may each be or comprise one or more downhole tools, modules, and/or other apparatus operable in wireline, while-drilling, coiled tubing, completion, production, and/or other operations. For example, the upper and lower portions 140, 160 may each be or comprise one or more of a cable head, a telemetry tool, a correlation tool, a directional tool, an acoustic tool, a density tool, an electromagnetic (EM) tool, a formation evaluation tool, a gravity tool, a formation logging tool, a magnetic resonance tool, a formation measurement tool, a monitoring tool, a neutron tool, a nuclear tool, a photoelectric factor tool, a porosity tool, a reservoir characterization tool, a resistivity tool, a seismic tool, a surveying tool, a release tool, fishing tool, a mechanical interface tool, valve key or engagement tool, a jarring or impact tool, a perforating tool, a cutting tool, a plug setting tool, and a plug.

The upper and lower portions 140, 160 may each further comprise inclination sensors and/or other position sensors, such as one or more accelerometers, magnetometers, gyroscopic sensors (e.g., micro-electro-mechanical system (MEMS) gyros), and/or other sensors for utilization in determining the orientation of the tool string 110 relative to the wellbore 120. The upper and lower portions 140, 160 may also comprise a correlation tool, such as a casing collar locator (CCL) operable to detect ends of casing collars by sensing a magnetic irregularity caused by the relatively high mass of an end of a collar of the casing 124. The correlation tool may also or instead be or comprise a gamma ray (GR) tool that may be utilized for depth correlation. The CCL and/or GR tools may transmit signals in real-time to the wellsite surface equipment 175, such as the power and control system 172, via the conveyance means 171. The CCL and/or GR signals may be utilized to determine the position of the tool string 110 or portions thereof, such as with respect to known casing collar numbers and/or positions within the wellbore 120. Therefore, the CCL and/or GR tools may be utilized to detect and/or log the location of the tool string 110 within the wellbore 120, such as during deployment within the wellbore 120 or other downhole operations.

The upper portion 140 may further comprise a linear actuation system, operable to impart a force to the impact tool 150 and/or the lower portion 160 to perform a well intervention operation or other mechanical work. The actuation system may comprise anchoring means operable to grip an inner surface 126 of the casing 124 and/or an inner surface of the wellbore 120 when the casing 124 is not utilized, such as to lock or maintain the actuation system in a predetermined fixed position within the wellbore 120. The actuation system may comprise a ram or a stroker tool operable to extend and retract in length or extend and retract a rod or shaft, such as to move the impact tool 150 and/or the lower portion 160 along the wellbore 120 or impart compression or tension to the impact tool 150 and/or the lower portion 160.

Figure 2:
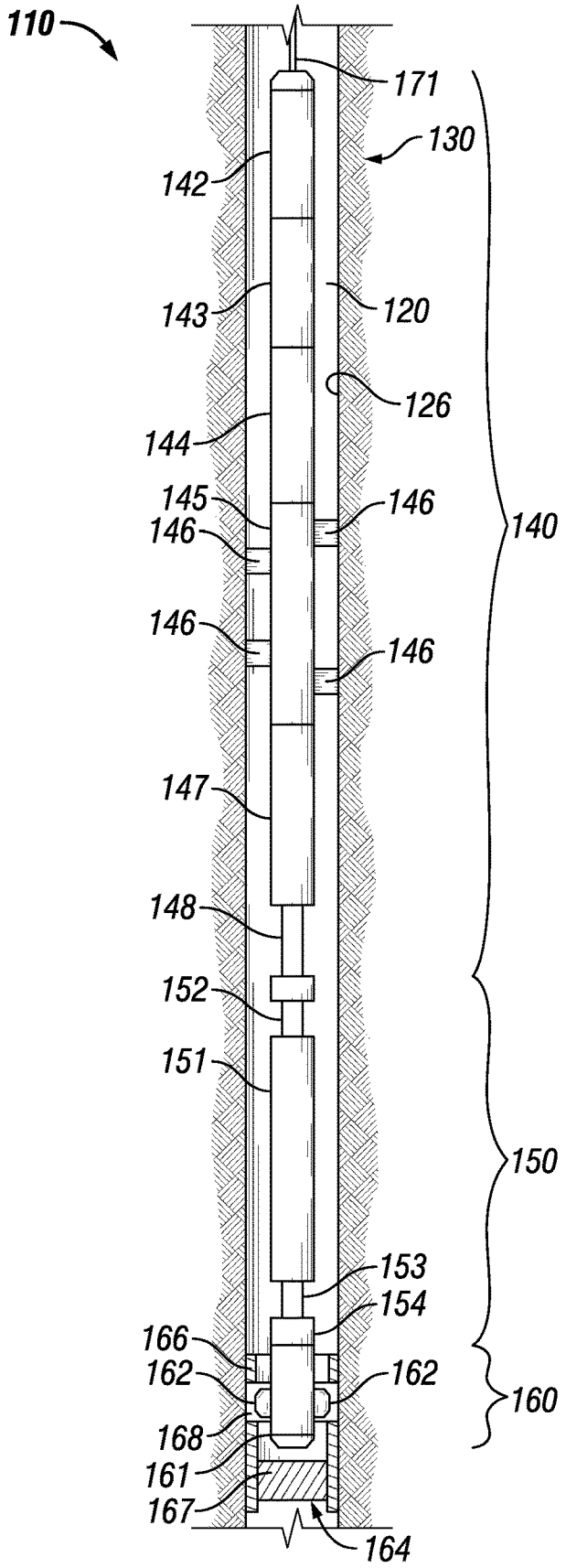
FIG. 2 is a schematic view of a portion of an example implementation of the apparatus shown in FIG. 1 according to one or more aspects of the present disclosure.

FIG. 2 is a side view of a portion of an example implementation of the tool string 110 shown in FIG. 1 according to one or more aspects of the present disclosure. The tool string 110 is shown comprising the upper portion 140, the lower portion 160, and the impact tool 150 coupled between the upper and lower portions 140, 160. The following description refers to FIGS. 1 and 2, collectively.

The upper portion 140 may comprise a cable head 142, which may be operable to connect the conveyance means 171 with the tool string 110. The upper portion 140 may further comprise a control sub 143 coupled with the cable head 142. The control sub 143 may comprise a downhole controller (not shown) communicatively coupled to the power and control system 172. The control sub 143 and/or the power and control system 172 may be configured to control operations of one or more portions and/or components of the tool string 110. For example, the control sub 143 and/or the power and control system 172 may be configured to receive and process data obtained from various sensors of the tool string 110, store the processed data, operate one or more portions and/or components of the tool string 110 based on the processed data, and/or communicate the processed data to the power and control system 172 or another component of the surface equipment 175. The control sub 143 may be further operable to receive control commands from the power and control system 172 for controlling one or more portions and/or components of the tool string 110.

The upper portion 140 may further comprise an anchor tool 145, a stroker tool 147, and a power sub 144 operable to provide power to operate the anchor tool 145, the stroker tool 147, and/or one or more portions and/or components of the tool string 110. For example, the power sub 144 may be or comprise a hydraulic power pack, which may be operable to supply hydraulic power to the anchor tool 145 and the stroker tool 147. The hydraulic power pack may provide a pressurized fluid to one or more fluid actuators of the anchor tool 145 to extend one or more movable gripping members 146 against the inner surface 126, such as may be operable to grip the casing 124 to lock or maintain at least a portion of the tool string 110 in a predetermined fixed position within the wellbore 120. The hydraulic power pack may further provide the pressurized fluid to the stroker tool 147 to extend and retract at least a portion of the stroker tool 147. For example, the high pressure fluid may be utilized to hydraulically extend and retract a ram or shaft 148 of the stroker tool 147. The shaft 148 may be connected with the impact tool 150, such as may permit the stroker tool 147 to move the impact tool 150 and the lower portion 160 axially along the wellbore 120 or to apply a force to the impact tool 150 and the lower portion 160. Instead of or in addition to the power sub 144 comprising the hydraulic power pack, the power sub 144 may comprise an electrical power source, such as a battery. In such implementation of the tool string 110, the battery may provide electrical power to electrical actuators, such as linear and/or rotary motors, to actuate the gripping members 146 and the shaft 148 in a manner described above. The power sub 144 may also be omitted from the tool string 110. In such implementation of the tool string 110, the hydraulic or electrical power may be provided from the wellsite surface 105 via the conveyance means 171.

The impact tool 150 may be coupled with the shaft 148 of the stroker tool 147 or the impact tool 150 may be coupled downhole from the stroker tool 147, such as may permit the stroker tool 147 to move or apply the force to the impact tool 150. The stroker tool 147 may apply the force to the impact tool 150 in the form of compression, for example, when the stroker tool 147 increases in length or extends the shaft 148 against the impact tool 150 to compress the impact tool 150. The stroker tool 147 may apply the force to the impact tool 150 in the form of tension, for example, when the stroker tool 147 decreases in length or retracts the shaft 148 away from the impact tool 150 to impart tension to the impact tool 150.

The impact tool 150 may be employed within the tool string 110 to perform or assist in the performance of well intervention operations or other downhole operations. For example, the impact tool 150 may be operable to receive and store energy (i.e., compression and tension) imparted to the impact tool 150 by the stroker tool 147 via the shaft 148 and then selectively release the stored energy in the form of an impact. The impact tool 150 may augment or otherwise increase the force generated by the stroker tool 147 by releasing the energy in a short period of time as a single impact. The impact may be imparted or otherwise directed to a predetermined portion of the tool string 110. For example, the impact tool 150 may impart the impact force to the lower portion 160, such as to provide the lower portion 160 with energy (i.e., force) sufficient to perform the intended well intervention or other downhole operation.

The lower portion 160 of the tool string 110 connected with the impact tool 150 may be or comprise an engagement tool 161, such as may be operable to connect, interface, or otherwise engage with an operatable or movable portion 166 of a downhole apparatus 164 located within the wellbore 120. The impact tool 150 may impart the impact to the movable portion 166 of the downhole apparatus 164 via the engagement tool 161 to move or otherwise operate the downhole apparatus 164. The movable portion 166 may be operatively connected with a fluid control or obstructing member 167 of the downhole apparatus 164 and configured to operate the fluid obstructing member 167 when mechanically moved or actuated. For example, the downhole apparatus 164 may be a fluid valve assembly, such as an isolation valve, a flapper valve, a gas-lift valve, a plug, or a packer, and the engagement tool 161 may be or comprise a setting tool or a shifting tool comprising one or more engagement members 162, such as keys, operable to engage the movable portion 166, such as a sliding sleeve, mandrel, or a bracket, configured to operate the fluid obstructing member 167, of the fluid valve assembly. The engagement members 162 may be operable to connect, interface, or otherwise engage with a corresponding receiving portion 168, such as a groove, notch, or a shoulder, of the movable portion 166. The engagement tool 161 may further comprise a fishing tool or another tool operable to connect, interface, or otherwise engage with the downhole apparatus 164 or another downhole tool that may be lodged or stuck within the wellbore 120 or stuck in a particular position or configuration. Accordingly, the impact tool 150 may impart the impact force to the engagement tool 161, such as to provide the engagement tool 161 with a force sufficient to actuate, move, operate, or dislodge the downhole apparatus 164.

To perform such operations, the downhole apparatus 164 or another downhole tool located within the wellbore 120 may be actuated, moved, operated, or dislodged in a downhole or downward direction, which may be referred to hereinafter as "down-shift" operations. During such operations, instead of potential energy being stored in the conveyance means 171, the potential energy may be stored in an energy storing member or means of the impact tool 150. During down-shift operations, the tool string 110 may be conveyed downhole until the engagement tool 161 engages with the downhole apparatus 164 or another downhole tool with the shaft 148 of the stroker tool 147 in a retracted position. Thereafter, the gripping members 146 may be set against the sidewall 126 to anchor the stroker tool 147 in a fixed position within the wellbore 120. Anchoring the stroker tool 147 also isolates the conveyance means 171 from the stroker and impact tools 147, 150, such that tension may not be transferred between the tensioning device 170 and the stroker and impact tools 147, 150. The stroker tool 147 may then be activated to extend the shaft 148 in the downhole direction. As the impact tool 150 is engaged with the downhole apparatus 164 via the engagement tool 161, the impact tool 150 may not move in the downhole direction, resulting in the impact tool 150 being compressed by the stroker tool 147. As compression is applied, potential energy may be stored in the energy storing member of the impact tool 150. When a predetermined compression force is reached or a predetermined amount of energy is stored by the impact tool 150, the impact tool 150 may be triggered to release the stored potential energy and converted it to kinetic energy. For example, the energy storing member may accelerate a housing 151 or another portion of the impact tool 150 in the downhole direction with respect to upper and lower shafts 152, 153 of the impact tool 150. The housing 151 may travel until it contacts or impacts another portion of the impact tool 150, such as a connector sub 154 connected with the shaft 153, to impart the impact force in the downhole direction. The impact force may be transmitted from the connector sub 154 to the engagement tool 161 and the downhole apparatus 164 to perform the down-shift operations on the downhole apparatus 164. Utilizing this approach, an impact force of up to about 50,000 pounds may be delivered to the downhole apparatus 164. However, it is to be understood that the magnitude of the impact force is scalable and the impact force may be more than 50,000 pounds, depending on the size of the impact tool 150.

The downhole apparatus 164 or another downhole tool located within the wellbore 120 may be actuated, moved, operated, or dislodged in an uphole or upward direction, which may be referred to hereinafter as "up-shift" operations. Similarly to the down-shift operations, instead of potential energy being stored in the conveyance means 171, the potential energy may be stored in an energy storing member or means of the impact tool 150. During the up-shift operations, the tool string 110 may be conveyed downhole until the engagement tool 161 engages with the downhole apparatus 164 or another downhole tool with the shaft 148 of the stroker tool 147 in an extended position. Thereafter, the gripping members 146 may be set against the sidewall 126 to anchor the stroker tool 147 in a fixed position within the wellbore 120. The stroker tool 147 may then be activated to retract the shaft 148 in the uphole direction. As the impact tool 150 is engaged with the downhole apparatus 164 via the engagement tool 161, the impact tool 150 may not move in the uphole direction, resulting in the impact tool 150 being subjected to tension by the stroker tool 147. As tension is applied, potential energy may be stored in the energy storing member of the impact tool 150. When a predetermined tension force is reached or a predetermined amount of energy is stored by the impact tool 150, the impact tool 150 may be triggered to release the stored potential energy and converted it to kinetic energy. For example, the energy storing member may accelerate the housing 151 or another portion of the impact tool 150 in the uphole direction. The housing 151 may travel until it contacts or impacts another portion of the impact tool 150, such as a portion of the shaft 153, to impart an impact force in the uphole direction. The impact force may be transmitted from the shaft 153 to the connector sub 154, the engagement tool 161, and the downhole apparatus 164 to perform the up-shift operations on the downhole apparatus 164. Utilizing this approach, an impact force of up to about 100,000 pounds may be delivered to the downhole apparatus 164 when a 10,000 pound tension or activation force is applied to the impact tool 150. However, it is to be understood that the magnitude of the impact force is scalable and the impact force may be greater than 100,000 pounds, depending on the size of the impact tool 150. For example, an impact force of up to about 150,000 pounds may be delivered to the downhole apparatus 164 when a 20,000 pound tension is applied to the impact tool 150.

As stated above, the downhole apparatus 164 may be an isolation valve, a flapper valve, a gas-lift valve, a plug, a packer, or another downhole valve or apparatus. FIGS. 3-6 are sectional views of example implementations of the downhole apparatus 164 that may be operated by one or more portions of the tool string 110, as described above. The following description refers to FIGS. 2-6, collectively.

Figure 3:
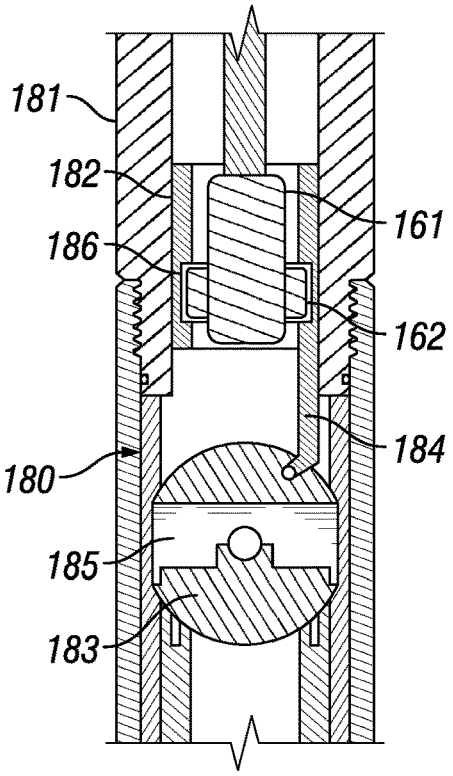
FIG. 3 is a sectional view of an apparatus related to one or more aspects of the present disclosure.
Figure 4:
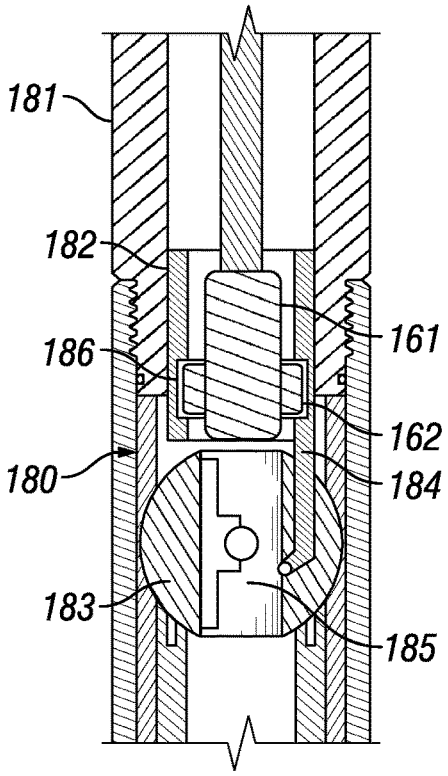
FIG. 4 is another view of the apparatus shown in FIG. 3 in a different stage of operation.

FIGS. 3 and 4 show a downhole valve assembly 180 disposed within a downhole tubular assembly 181 and operable to shut off or otherwise limit fluid flow through the tubulars 181. The valve assembly 180 comprises a movable sleeve 182 operatively connected with a ball member 183 via a bracket 184 pivotally connected with the ball member 183. The movable sleeve 182 comprises a recess 186 configured to receive, accommodate, or otherwise engage with the engagement members 162 of the engagement tool 161. The ball member 183 comprises a bore 185 or fluid pathway extending therethrough and may be operated or rotated to selectively permit, prevent, or otherwise limit fluid flow through the valve assembly 180 by operating or moving the movable sleeve 182. FIG. 3 shows the movable sleeve 182 in a raised position and the ball member 183 in a closed-flow position, while FIG. 4 shows the movable sleeve 182 in a lowered position and the ball member 183 in an open-flow position. Accordingly, the down-shift operation may be performed on the valve assembly 180 to shift the ball-member 183 to the open-flow position, while the up-shift operation may be performed on the valve assembly 180 to shift the ball-member 183 to the closed-flow position.

Figure 5:
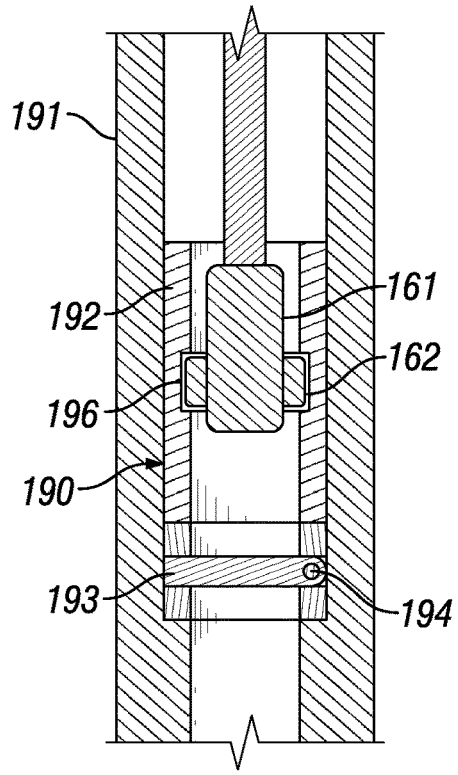
FIG. 5 is a sectional view of an apparatus related to one or more aspects of the present disclosure.
Figure 6:
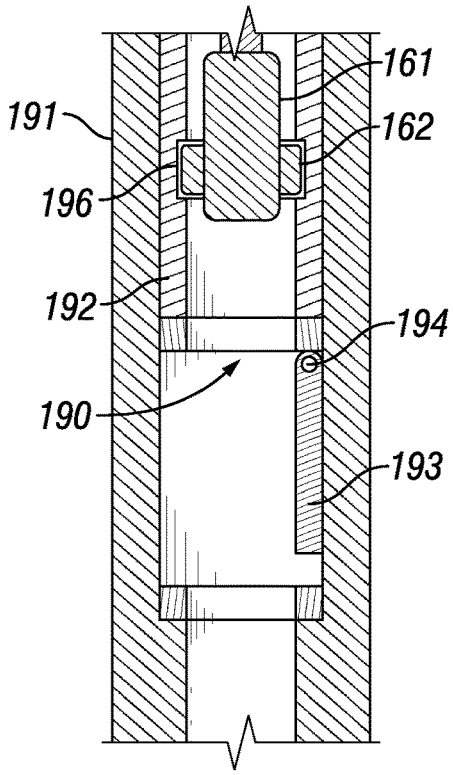
FIG. 6 is another view of the apparatus shown in FIG. 5 in a different stage of operation.

FIGS. 5 and 6 show a downhole valve assembly 190 disposed within a downhole tubular 191 and operable to shut off or otherwise limit fluid flow through the tubular 191. The valve assembly 190 comprises a movable sleeve 192 operatively connected with a flapper 193 via a pivot connection 194. The movable sleeve 192 comprises a recess 196 configured to receive, accommodate, or otherwise engage with the engagement members 162 of the engagement tool 161. The flapper 193 is may be operated or pivoted to selectively permit, prevent, or otherwise limit fluid flow through the valve assembly 190 by operating or moving the movable sleeve 192. FIG. 5 shows the movable sleeve 192 in a lowered position and the flapper 193 in a closed-flow position, while FIG. 6 shows the movable sleeve 192 in a raised position and the flapper 193 in an open-flow position. Accordingly, down-shift operations may be performed on the valve assembly 190 to shift the flapper 193 to the closed-flow position, while up-shift operations may be performed on the valve assembly 190 to shift the flapper 193 to the open-flow position.

Figure 7:
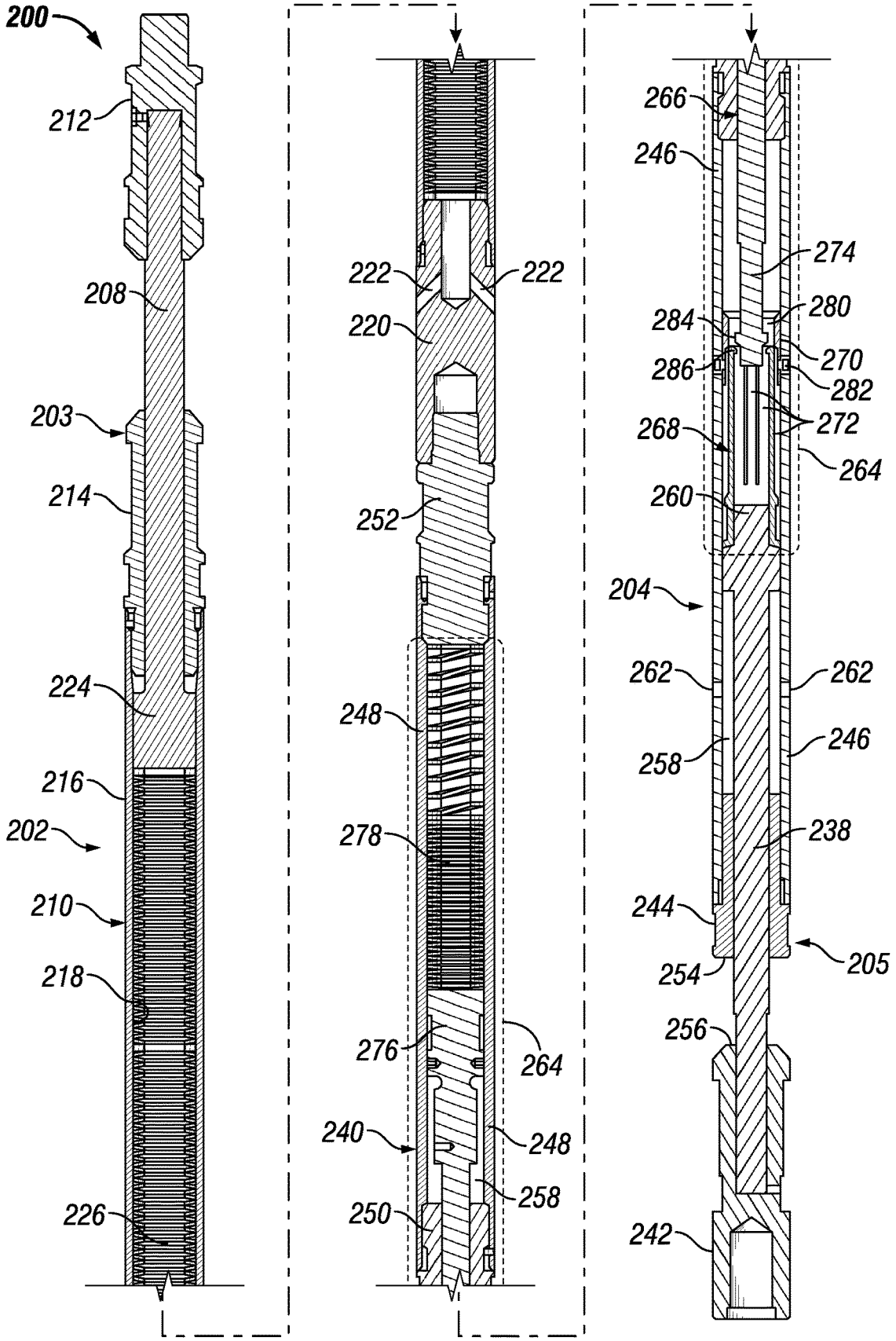
FIG. 7 is a sectional view of at least a portion of an example implementation of apparatus according to one or more aspects of the present disclosure.

The present disclosure further relates to an example implementation of the impact tool 150 for connection between opposing upper and lower portions 140, 160 of the tool string 110 and configured for use in the down-shift operations. FIG. 7 is a sectional view of at least a portion of an example implementation of the impact tool 150 shown in FIGS. 1 and 2 configured for use in the down-shift operations, designated in FIG. 7 by numeral 200. The following description refers to FIGS. 1, 2, and 7, collectively.

The impact tool 200 may comprise an upper portion 202, which may be operable to store energy imparted to the impact tool 200 by the stroker tool 147, and a lower portion 204, which may be operable to selectively trigger the release of the energy stored in the upper portion 202 to generate an impact. The upper portion 202 may comprise a housing assembly 210 and a shaft 208 axially movable relative to each other. The shaft 208 may be disposed within at least a portion of the housing assembly 210 and may extend from within or out of the housing assembly 210 in the uphole direction. The shaft 208 may be fixedly connected with a connector sub 212, which may be operable to connect the impact tool 200 with the shaft 148 or another portion of the stroker tool 147. Accordingly, the impact tool 200 and the stroker tool 147 may be connected together via their respective shafts 148, 208. The connector sub 212 may comprise external or internal threads, fasteners, couplings, connectors, field joints, and/or other mechanical and/or electrical connection means operable to mechanically and/or electrically connect the impact tool 200 with a corresponding mechanical and/or electrical connection means of the stroker tool 147.

The housing assembly 210 may comprise a stop section 214 operable to accommodate therethrough and/or permit slidable movement between the shaft 208 and the housing assembly 210. The stop section 214 may also fluidly seal against the shaft 208. The stop section 214 may be coupled with a housing section 216, which may define a bore or chamber 218 configured to accommodate at least a portion of the shaft 208 therein. The housing section 216 may be coupled with an end section 220, which may comprise one or more fluid channels or ports 222 fluidly connecting the chamber 218 with a space external to the impact tool 200, such as the wellbore 120. The ports 222 may be configured to communicate wellbore or other fluids into and out of the chamber 218 as the shaft 208 moves into and out of the chamber 218. The shaft 208 may extend at least partially into the chamber 218 and terminate with a retaining portion 224, which may be operable to retain the shaft 208 within the chamber 218.

The upper portion 202 may further comprise an energy storing member 226 disposed within the chamber 218 and operable to store and output mechanical energy during the down-shift operations. For example, the energy storing member 226 may be or comprise a biasing member, such as one or more sets of Belleville springs, wave springs, compression springs, and/or other biasing members operable to store elastic energy. The energy storing member 226 may be located within the chamber 218 between the retaining member 224 of the shaft 208 and the end section 220 of the housing assembly 210, such as may permit the energy storing member 226 to be compressed by way of relative motion between the housing assembly 210 and the shaft 208. For example, the energy storing member 226 may be configured to expand axially within the chamber 218 and/or resist compression, such as to bias the shaft 208 to move in the uphole direction or extend out of the housing assembly 210 or to bias the housing assembly 210 to move in the downhole direction with respect to the shaft 208. Accordingly, energy may be imparted to the energy storing member 226 by forcing the shaft 208 into the chamber 218 of the housing assembly 210 to compress the energy storing member 226 between the shaft 208 and the end section 220 of the housing assembly 210.

The lower portion 204 of the impact tool 200 may comprise a housing assembly 240 and a shaft 238 axially movable relative to each other. The shaft 238 may be disposed within at least a portion of the housing assembly 240 and may extend from within or out of the housing assembly 240 in the downhole direction. The shaft 238 may be fixedly connected with a connector sub 242, which may be operable to connect the impact tool 200 with the engagement tool 161 or another portion of the tool string 110. The connector sub 242 may comprise external or internal threads, fasteners, couplings, connectors, field joints, and/or other mechanical and/or electrical connection means operable to mechanically and/or electrically connect the impact tool 200 with a corresponding mechanical and/or electrical connection means of the engagement tool 161 or another portion of the tool string 110.

The housing assembly 240 may comprise a stop section 244 configured to accommodate therethrough and/or permit slidable movement between the shaft 238 and the housing assembly 240. The stop section 244 may also fluidly seal against the shaft 238. The stop section 244 may be coupled with a housing section 246, which may be may be coupled with another housing section 248 via a connector section 250. The housing section 248 may be coupled with an end section 252, which may be coupled with the end section 220 to couple the housing assemblies 210, 240 and, thus, the upper and lower portions 202, 204 of the impact tool 200. As the housing assemblies 210, 240 are fixedly coupled via the end sections 220, 252, the housing assemblies 210, 240 may move in unison and, thus, may be considered as a single unit or housing assembly having opposing ends 203, 205, with the shafts 208, 238 extending from the single housing assembly at the opposing ends 203, 205, respectively.

A lower portion of the stop section 244 may comprise an impact feature 254, which may be implemented as an outwardly extending radial surface, shoulder, boss, flange, and/or another impact member. The impact feature 254 may be operable to impact or collide with a corresponding impact feature 256, which may be implemented as an inwardly extending radial shoulder, boss, flange, and/or another impact member integral with or otherwise carried by the connector sub 242. Although the corresponding impact features 254, 256 are described as being integral with or carried by the stop section 244 and the connector sub 242, respectively, it is to be understood that the impact features 254, 256 may be integral with or carried by other portions of the impact tool 200. For example, the impact features 254 may be integral with or carried by the housing section 246, while the impact feature 256 may be integral to or carried by the shaft 238.

The stop section 244, the housing section 246, the connector section 250, and the housing section 248 of the housing assembly 240 may define a bore or chamber 258 configured to accommodate at least a portion of the shaft 238 therein. The shaft 238 may extend into the chamber 258 and terminate with a retaining portion 260, which may be operable to retain the shaft 238 within the chamber 258. The housing section 246 or another portion of the housing assembly 240 may comprise one or more fluid channels or ports 262 fluidly connecting the chamber 258 with the space external to the impact tool 200, such as the wellbore 120. The ports 262 may be configured to communicate wellbore or other fluids into and out of the chamber 258 as the shaft 238 moves into and out of the chamber 258.

The lower portion 204 of the impact tool 200 may further comprise a latching mechanism 264, such as may be operable to trigger the impact between the impact features 254, 256 during the down-shift operations or otherwise release the energy stored within the energy storing member 226. The latching mechanism 264 may be disposed within the chamber 258 and may be operable to selectively limit and permit relative motion between the housing assembly 240 and the shaft 238 by selectively engaging and disengaging the housing assembly 240 and the shaft 238. Accordingly, the latching mechanism 264 may be operable to selectively trigger the impact between the impact features 254, 256.

The latching mechanism 264 may comprise an upper latch portion 266, a lower latch portion 268, and an anti-release member 270. The lower latch portion 268 may be fixedly connected to or otherwise carried by the shaft 238 and, thus, axially movable with the shaft 238. Such connection may be established via threaded means, fasteners, pins, press/interference fit, and/or other connection means. The lower latch portion 268 may comprise a plurality of flexible members 272 collectively operable to detachably engage the upper latch portion 266 and the anti-release member 270.

The upper latch portion 266 may comprise an internal shaft 274 slidably disposed within the chamber 258 of the housing assembly 240, extending at least partially through the housing sections 248, 246 and the connector 250 between the end section 252 and the lower latch portion 268. An upper end of the internal shaft 274 may terminate with a retaining portion 276, which may be operable to retain the internal shaft 274 in a predetermined position or otherwise limit the range of axial motion of the internal shaft 274 within the chamber 258. The upper latch portion 266 may further comprise a biasing member 278 disposed within the chamber 258 of the housing assembly 240, between the end section 252 and the retaining portion 276 of the internal shaft 274. The biasing member 278 may be operable to bias or urge the internal shaft 274 to remain in a predetermined axial position along the chamber 258 and to resist axial movement along the chamber 258, such as when the internal shaft 274 and/or the housing assembly 240 is acted upon or imparted by a force, including the compression force imparted by the stroker tool 147, as further described below. The biasing member 278 may comprise a predetermined or adjustable stiffness to control relative movement between the internal shaft 274 and the housing assembly 240. That is, the biasing member 278 may be selected such that the internal shaft 274 and the housing assembly 240 move relative to each other in a predetermined manner when the force is applied to the internal shaft 274 and/or the housing assembly 240. The biasing member 278 may comprise one or more sets of Belleville springs, wave springs, compression springs, and/or other biasing members operable to resist compression.

The anti-release member 270 may be disposed about at least a portion of the upper and lower latch portions 266, 268 and may be configured to engage the lower latch portion 268 and/or maintain engagement between the upper and lower latch portions 266, 268. The anti-release member 270 may be disposed within the chamber 258 and connected with the housing section 246. The anti-release member 270 may comprise an axial bore 280 configured to accommodate at least a portion of both the flexible members 272 and the internal shaft 274 of the lower and upper latch portions 266, 268, respectively.

The anti-release member 270 may be integral to the housing section 246 or may be implemented as a sleeve fixedly connection with the housing section 246 via one or more set screws 282, fasteners, pins, and/or other connection means.

The engagement between the upper and lower latch portions 266, 268 may be facilitated via engagement between an external profile 284 along the internal shaft 274 of the upper latch portion 266 and a plurality of internal profiles 286, each located along a corresponding flexible member 272 of the lower latch portion 268. During down-shift operations, forces applied to the impact tool 200 may cause the external profile 284 and the internal profiles 286 to come into contact or engage each other to prevent or limit relative motion between the upper and lower latch portions 266, 268 and, thus, prevent or limit relative motion between the housing assembly 240 and the shaft 238. As the flexible members 272 may deflect outwardly to disengage the profiles 284, 286, the engagement between the profiles 284, 286 may be maintained by the anti-release member 270, which may be configured to prevent the profiles 284, 286 from bypassing each other or otherwise disengaging. For example, the axial bore 280 of the anti-release member 270 may be sized to prevent or limit outwardly deflection or movement of the flexible members 272 to prevent the profiles 284, 286 from bypassing each other and, thus, prevent or limit relative motion between the housing assembly 240 and the shaft 238. Accordingly, to perform the down-shift operations, the external profile 284 may be initially located uphole from the internal profiles 286, such that when the impact tool 200 is compressed, the upper latch portion 266 and, thus, the housing assembly 240, is initially prevented from moving in the downhole direction with respect to the shaft 238.

Although not depicted in FIG. 7, it is to be understood that the impact tool 200 may comprise a bore extending longitudinally through the various components of the impact tool 200. The bore may be operable to accommodate or receive therethrough the electrical conductor 155 shown in FIG. 1 and described above.

Figure 8:
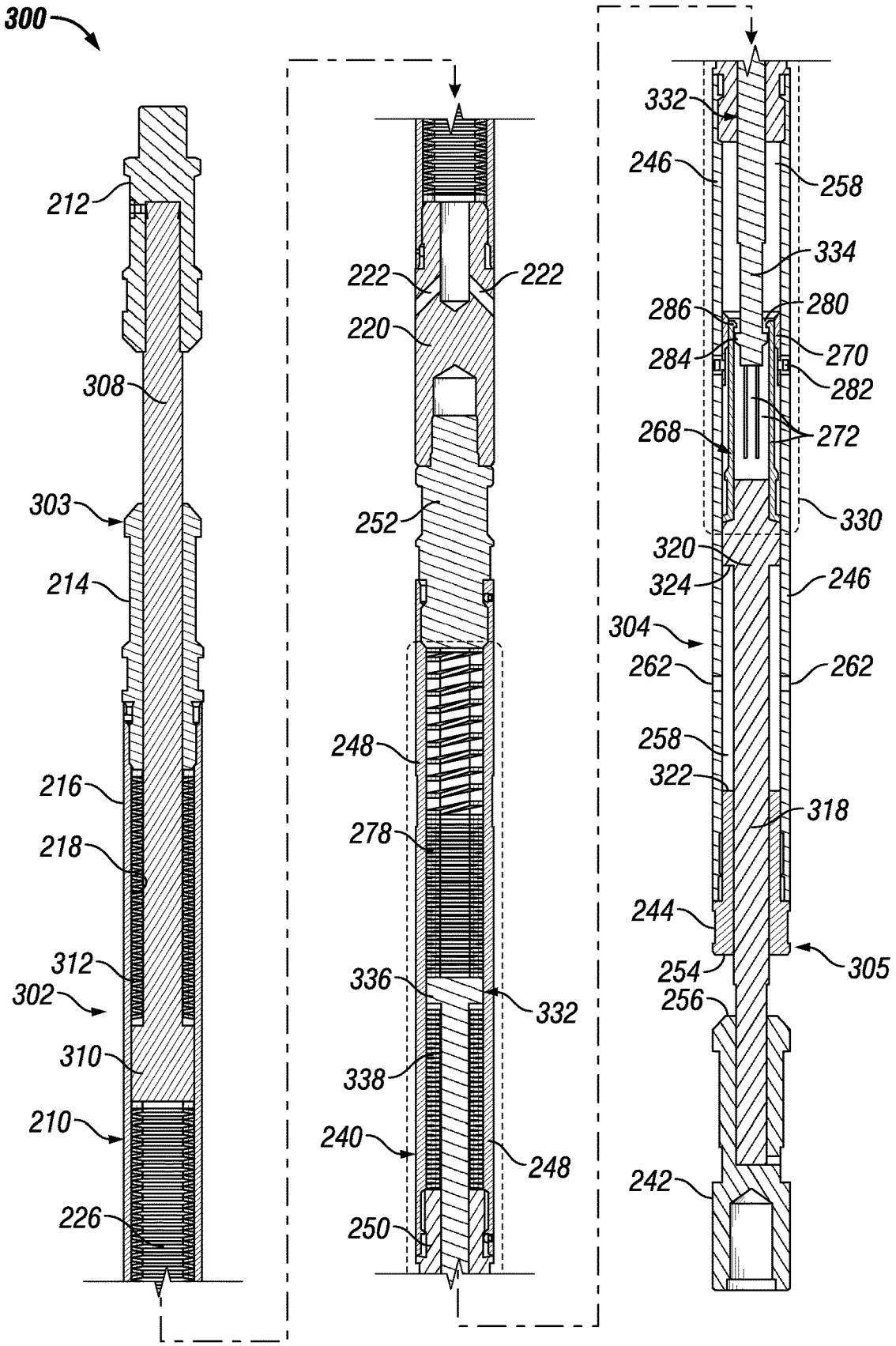
FIG. 8 is a sectional view of at least a portion of an example implementation of apparatus according to one or more aspects of the present disclosure.

FIG. 8 is a sectional view of an example implementation of an impact tool 300 configured for use in the down-shift and up-shift operations according to one or more aspects of the present disclosure. The impact tool 300 comprises one or more similar features of the impact tool 200 shown in FIG. 7, except as described below. The following description refers to FIGS. 1, 2, and 8, collectively.

The impact tool 300 may comprise an upper portion 302, which may be operable to store energy imparted to the impact tool 300 by the stroker tool 147, and a lower portion 304, which may be operable to trigger the release of the energy stored in the upper portion 302 to generate an impact. The upper portion 302 may comprise a housing assembly 210 and a shaft 308 axially movable relative to each other. The shaft 308 may be disposed within at least a portion of the housing assembly 210 and may extend from within or out of the housing assembly 210 in the uphole direction. The shaft 308 may be fixedly connected with a connector sub 212, which may be operable to connect the impact tool 300 with the shaft 148 or another portion of the stroker tool 147. Accordingly, the impact tool 300 and the stroker tool 147 may be connected together via their respective shafts 148, 308. The housing assembly 210 may define a bore or chamber 218 configured to accommodate at least a portion of the shaft 308 therein. The shaft 308 may extend at least partially into the chamber 218 and terminate with a retaining portion 310, which may be operable to retain the shaft 308 within the chamber 218.

The upper portion 302 may further comprise energy storing members 312, 226 disposed within the chamber 218 on opposing sides of the retaining portion 310 of the shaft 308 and operable to store and output mechanical energy during up-shift and down-shift operations, respectively. For example, the energy storing members 312, 226 may be or comprise biasing members, such as one or more sets of Belleville springs, wave springs, compression springs, and/or other biasing members operable to store elastic energy. The energy storing member 312 may be located within the chamber 218 between the stop section 214 of the housing assembly 210 and the retaining member 310 of the shaft 308, such as may permit the energy storing member 312 to be compressed by way of relative motion between the housing assembly 210 and the shaft 308. For example, the energy storing member 312 may be configured to expand axially within the chamber 218 and/or resist compression, such as to bias the shaft 308 to move in the downhole direction or retract into the housing assembly 210 and/or bias the housing assembly 210 to move in the uphole direction with respect to the shaft 308. Accordingly, energy may be imparted to the energy storing member 312 by forcing the shaft 308 out of the chamber 218 of the housing assembly 210 to compress the energy storing member 312 between the retaining member 310 and the stop section 214. As described above, the energy storing member 226 may be located within the chamber 218 between the retaining member 310 and the end section 220, such as may permit the energy storing member 226 to be compressed by way of relative motion between the housing assembly 210 and the shaft 308 to store energy.

The lower portion 304 of the impact tool 300 may comprise a housing assembly 240 and a shaft 318 axially movable relative to each other. The shaft 318 may be disposed within at least a portion of the housing assembly 240 and may extend from within or out of the housing assembly 240 in the downhole direction. The shaft 318 may be fixedly connected with a connector sub 242, which may be operable to connect the impact tool 300 with the engagement tool 161 or another portion of the tool string 110. The housing assemblies 210, 240 may be fixedly coupled via the end sections 220, 252, such as may permit the housing assemblies 210, 240 to move in unison. Accordingly, the housing assemblies 210, 240 may be considered as a single unit or housing assembly having opposing ends 303, 305, with the shafts 308, 318 extending from the single housing assembly at the opposing ends 303, 305, respectively.

In addition to the impact features 254, 256 for imparting an impact in the downhole direction, the impact tool 300 may further comprise impact features for imparting an impact in the uphole direction. For example, an upper portion of the stop section 244 may comprise an impact feature 322, which may be implemented as an outwardly extending radial surface, shoulder, boss, flange, and/or another impact member. The impact feature 322 may be operable to impact or collide with a corresponding impact feature 324, which may be implemented as an inwardly extending radial shoulder, boss, flange, and/or another impact member integral with or otherwise carried by the shaft 318. Although the impact feature 322 is described as being integral with or carried by the stop section 244, it is to be understood that the impact feature 322 may be integral with or carried by other portions of the impact tool 300, such as the housing section 246.

The stop section 244, the housing section 246, the connector section 250, and the housing section 248 of the housing assembly 240 may define a bore or chamber 258 configured to accommodate at least a portion of the shaft 318 therein. The shaft 318 may extend into the chamber 258 and terminate with a retaining portion 320, which may be operable to retain the shaft 318 within the chamber 258. The housing section 246 or another portion of the housing assembly 240 may comprise one or more fluid channels or ports 262 fluidly connecting the chamber 258 with the space external to the impact tool 300, such as the wellbore 120.

The lower portion 204 may further comprise a latching mechanism 330, such as may be operable to trigger the impact between the impact features 254, 256 and between the impact features 322, 324 during down-shift and up-shift operations, respectively. The latching mechanism 330 may be disposed within the chamber 258 and may be operable to selectively limit and permit relative motion between the housing assembly 240 and the shaft 308 by selectively engaging and disengaging the housing assembly 240 and the shaft 308. Accordingly, the latching mechanism 330 may be operable to selectively trigger the impact between the impact features 254, 256 and between the impact features 322, 324.

The latching mechanism 264 may comprise an upper latch portion 332, a lower latch portion 268, and an anti-release member 270. The lower latch portion 268 may be fixedly connected to or otherwise carried by the shaft 308 and, thus, axially movable with the shaft 308. The lower latch portion 268 may comprise a plurality of flexible members 272 collectively operable to detachably engage the upper latch portion 332 and the anti-release member 270.

The upper latch portion 332 may comprise an internal shaft 334 slidably disposed within the chamber 258 of the housing assembly 240, extending at least partially through the housing sections 248, 246 and the connector 250 between the end section 252 and the lower latch portion 268. An upper end of the internal shaft 334 may terminate with a retaining portion 336, which may be operable to retain the internal shaft 334 in a predetermined position or otherwise limit the range of axial motion of the internal shaft 334 within the chamber 258. The upper latch portion 332 may further comprise biasing members 278, 338 disposed within the chamber 258 of the housing assembly 240 on opposing sides of the retaining portion 336 of the internal shaft 334. The biasing members 278, 338 may be operable to bias or urge the internal shaft 334 to remain in a predetermined axial position along the chamber 258 and to resist uphole and downhole axial movements along the chamber 258, such as when the internal shaft 334 and/or the housing assembly 240 is acted upon or imparted by a force, including compression and tension forces imparted by the stroker tool 147, as further described below. The biasing members 278, 338 may comprise a predetermined or adjustable stiffness to control relative movement between the internal shaft 334 and the housing assembly 240. That is, the biasing members 278, 338 may be selected such that the internal shaft 334 and the housing assembly 240 move relative to each other in a predetermined manner when the force is applied to the internal shaft 334 and/or the housing assembly 240. The biasing members 278, 338 may comprise one or more sets of Belleville springs, wave springs, compression springs, and/or other biasing members operable to resist compression.

The anti-release member 270 may be disposed about at least a portion of the upper and lower latch portions 332, 268 and may be configured to engage the lower latch portion 268 and/or maintain engagement between the upper and lower latch portions 332, 268. The anti-release member 270 may comprise an axial bore 280 configured to accommodate at least a portion of both the internal shaft 334 and the flexible members 272 of the upper and lower latch portions 332, 268, respectively.

The engagement between the upper and lower latch portions 332, 268 may be facilitated via engagement between an external profile 284 along the internal shaft 334 of the upper latch portion 332 and a plurality of internal profiles 286, each located along a corresponding flexible member 272 of the lower latch portion 268. During operations, forces applied to the impact tool 300 may cause the external profile 284 and the internal profiles 286 to come into contact or engage each other to prevent or limit relative motion between the upper and lower latch portions 332, 268 and, thus, prevent or limit relative motion between the housing assembly 240 and the shaft 318. As the flexible members 272 may deflect outwardly to disengage the profiles 284, 286, the engagement between the profiles 284, 286 may be maintained by the anti-release member 270, which may be configured to prevent the profiles 284, 286 from bypassing each other or otherwise disengaging. To perform the down-shift operations, the external profile 284 may be initially located uphole from the internal profiles 286, as shown in FIG. 7, such that when the impact tool 300 is compressed, the upper latch portion 332 and, thus, the housing assembly 240, is initially prevented from moving in the downhole direction with respect to the shaft 318. To perform the up-shift operations, the external profile 284 may be initially located downhole from the internal profiles 286, as shown in FIG. 8, such that when the impact tool 300 is put under tension, the upper latch portion 332 and, thus, the housing assembly 240, is initially prevented from moving in the uphole direction with respect to the shaft 318.

Although not depicted in FIG. 8, it is to be understood that the impact tool 300 may comprise a bore extending longitudinally through the various components of the impact tool 300. The bore may be operable to accommodate or receive therethrough the electrical conductor 155 shown in FIG. 1 and described above.

The present disclosure also relates to methods of utilizing the tool sting 110, including the impact tools 200, 300 to perform the down-shift and up-shift operations according to one or more aspects of the present disclosure. The methods may be performed utilizing or otherwise in conjunction with at least a portion of one or more implementations of one or more instances of the apparatus shown in one or more of FIGS. 1-8 and/or otherwise within the scope of the present disclosure. Thus, the following description of the methods also refers to apparatus shown in one or more of FIGS. 1-8. However, the methods may also be performed in conjunction with implementations of apparatus other than those depicted in FIGS. 1-8, which are also within the scope of the present disclosure.

Before or after being coupled along the tool string 110, the impact tool 200, 300 may be configured to trigger an impact when a predetermined compression or tension force is applied to the impact tool 200, 300 by the stroker tool 147. For example, the impact tool 200, 300 may be configured to trip when about 10,000 pounds of force is applied. When a 24,000 pound rated stroker 147 is utilized, the impact tool 200, 300 may be configured to trip when about 20,000 pounds of force is applied. The triggering force of the impact tool 200, 300 may be configured, for example, by adjusting the stiffness or the resistance of one or both of the biasing members 278, 338 and/or by adjusting the axial position or axial length of the anti-release member 270 with respect to the external profile 284 of the latching mechanism 330.

Before being conveyed into the wellbore 120, the impact tool 200, 300 may be directly or indirectly coupled with the stroker tool 147, such as may permit the stroker tool 147 to impart a force to the impact tool 200, 300 and permit the impact tool 200, 300 to store the energy (i.e., force) imparted by the stroker tool 147. For example, shaft 148 of the stroker tool 147 may be directly or indirectly coupled with the shaft 208, 308 of the impact tool 200, 300, such as may permit the stroker tool 147 to transmit energy to the energy storing members 226, 312 of the impact tool 200, 300. Once the impact tool 200, 300 is coupled to the tool string 110, the tool string 110 may be conveyed into the wellbore 120 to a predetermined depth or position.

To perform the down-shift operations on the downhole apparatus 164 utilizing the impact tool 200, 300, the shaft 148 of the stroker tool 147 may be fully retracted and the shaft 238, 318 of the impact tool 200, 300 may be extended such that the internal profiles 286 of the lower latch portion 268 are located downhole from the external profile 284 of the upper latch portion 266, 332, as shown in FIG. 7. When the predetermined position is reached by the tool string 110, the engagement tool 161 may be connected with the downhole apparatus 164 that is stuck or intended to be actuated.

Once the engagement tool 161 engages the downhole apparatus 164, the power sub 144 may actuate the plurality of gripping members 146 of the anchor tool 145 to set the gripping members 146 against the sidewall 126 of the casing 124 to lock the tool string 110 in position within the wellbore 120 and isolate the conveyance means 171 and/or weak points of the tool string 110. The power sub 144 may then actuate the shaft 148 of the stroker tool 147 to extend and impart compression to the impact tool 200, 300 and the engagement tool 161 or force the impact tool 200, 300 and the engagement tool 161 in the downhole direction with respect to or against the downhole apparatus 164. As the impact tool 200, 300 is compressed, the profiles 284, 286 may engage and prevent the shaft 238, 318 from retracting into the housing assembly 240, thereby latching the housing assemblies 210, 240 with the shaft 238, 318 to prevent the housing assemblies 210, 240 from moving in the downhole direction.

If the downhole apparatus 164 does not initially move or shift in the downhole direction, the shaft 148 of the stroker tool 147 may continue to extend against the shaft 208, 308 of the impact tool 200, 300 until the shaft 208, 308 starts to retract into the chamber 218 compressing the energy storing member 226. The shaft 208, 308 may, thus, be operable to transmit the force from the stroker tool 147 to the energy storing member 226 of the impact tool 200, 300. The energy storing member 226 may continue to be compressed, storing an increasing amount of mechanical energy, until the upper connector sub 212 and the stop section 214 contact each other or until the compression force becomes greater than the biasing force of the biasing member 278 of the latching mechanism 264, 330. At such point, the biasing member 278 may undergo compression and permit the housing assemblies 210, 240 and the anti-release member 270 to move in the downhole direction with respect to the internal shafts 274, 334 and the shafts 238, 318 until the anti-release member 270 moves past the internal profiles 286 of the lower latch portion 268 to permit the flexible members 272 to expand and disengage the upper latch portion 266, 332 from the lower latch portion 268.

Once disengaged, the upper latch portion 266, 332 and, thus, the upper and lower housings 210, 240 are free to move with respect to the shaft 208, 308 and the shaft 238, 318. As the shaft 208, 308 is coupled with the stroker tool 147 and, thus, is maintained in a substantially fixed position, the energy storing member 226 may expand and push the housing assemblies 210, 240 in the downhole direction until the impact feature 254 contacts the impact feature 256 to impart a downwardly directed impact to the connector sub 242, which may be transmitted to the engagement tool 161 and to the downhole apparatus 164 connected with the engagement tool 161. If the downhole apparatus 164 does not actuate or becomes unstuck, the stroker tool 147 may retract the shaft 148 to reset the impact tool 200, such as may permit the down-shift operations to be repeated as needed.

To perform the up-shift operations on the downhole apparatus 164 utilizing the impact tool 300, the shaft 148 of the stroker tool 147 may be fully extended and the shaft 318 of the impact tool 300 may be retracted such that the internal profiles 286 of the lower latch portion 268 are located uphole from the external profile 284, as shown in FIG. 8. When the predetermined position within the wellbore 120 is reached by the tool string 110, the engagement tool 161 may be connected with the downhole apparatus 164 that is stuck or intended to be actuated.

Once the engagement tool 161 engages the downhole apparatus 164, the power sub 144 may actuate the plurality of gripping members 146 of the anchor tool 145 to set the gripping members 146 against the sidewall 126 of the casing 124 to couple the tool string 110 in position along the wellbore 120 and isolate the conveyance means 171 and/or weak points of the tool string 110. The power sub 144 may then actuate the shaft 148 of the stroker tool 147 to retract to impart tension to the impact and engagement tools 300, 161 or force the impact and engagement tools 300, 161 in the uphole direction with respect to the downhole apparatus 164. As the impact tool 300 is put under tension, the profiles 284, 286 may engage and prevent the shaft 318 from extending from within the housing assembly 240, thereby latching the housing assemblies 210, 240 with the shaft 318 to prevent the housing assemblies 210, 240 from moving in the uphole direction.

If the downhole apparatus 164 does not initially move or shift in the uphole direction, the shaft 148 of the stroker tool 147 may continue to retract pulling on the shaft 308 of the impact tool 300 until the shaft 308 starts to extend out of the chamber 218 compressing the energy storing member 312.

The shaft 308 may, thus, be operable to transmit the force from the stroker tool 147 to the energy storing member 312 of the impact tool 300. The energy storing member 312 may continue to be compressed, storing an increasing amount of mechanical energy, until the energy storing member 312 is fully compressed or until the compression force becomes greater than the biasing force of the biasing member 338 of the latching mechanism 330. At such point, the biasing member 338 may undergo compression and permit the housing assemblies 210, 240 and the anti-release member 270 to move in the uphole direction with respect to the internal shaft 334 and shaft 318 until the anti-release member 270 moves past the internal profiles 286 of the lower latch portion 268 to permit the flexible members 272 to expand and disengage the upper latch portion 332 from the lower latch portion 268.

Once disengaged, the upper latch portion 332 and, thus, the upper and lower housings 210, 240 are free to move with respect to the shafts 308, 318. As the shaft 308 is coupled with the stroker tool 147 and, thus, is maintained in a substantially fixed position, the energy storing member 312 may expand and push the housing assemblies 210, 240 in the uphole direction until the impact feature 322 contacts the impact feature 324 to impart an upwardly directed impact to the shaft 308, which may be transmitted to the connector sub 242, the engagement tool 161, and the downhole apparatus 164 connected with the engagement tool 161. If the downhole apparatus 164 does not actuate or becomes unstuck, the stroker tool 147 may extend the shaft 148 to reset the impact tool 300, such as may permit the up-shift operations to be repeated as needed.

Although not described with respect to the impact tool 300, the impact tool 300 may also be operable to perform the down-shift operations. Such down-shift operations may be performed in substantially similar or same manner as the down-shift operations described above with respect to the impact tool 200.

Although not shown in FIGS. 7 and 8, an impact tool within the scope of the present disclosure may include an impact tool operable to perform the up-shift operations, but not the down-shift operations. Such impact tool may comprise a structure that is substantially the same or similar to the impact tool 300 described above, except as described below. For example, such impact tool may comprise the energy storing member 312, but not the energy storing member 226. Furthermore, such impact tool may comprise the biasing member 338, but not the biasing member 278. Such impact tool may also comprise the impact features 322, 324, but not the impact features 254, 256. Also, the manner of operation of such impact tool to perform the up-shift operations may be substantially similar or the same as the up-shift operations described above with respect to the impact tool 300.

In view of the entirety of the present disclosure, including the claims and the figures, a person having ordinary skill in the art will readily recognize that the present disclosure introduces an apparatus comprising: an impact tool for coupling between opposing first and second portions of a downhole tool string, wherein the impact tool comprises: a housing having opposing first and second ends; a first shaft extending out from the first end of the housing, wherein the housing and the first shaft are axially movable relative to each other; a second shaft extending out from the second end of the housing, wherein the housing and the second shaft are axially movable relative to each other; an energy storing member disposed within the housing; and a latching mechanism operable to selectively permit relative motion between the housing and the second shaft to release energy stored in the energy storing member to impart an impact to the downhole tool string.

The latching mechanism may be further operable to limit the relative motion between the housing and the second shaft.

At least a portion of the latching mechanism may be connected with the second shaft.

At least a portion of the latching mechanism may be connected with the housing.

The energy storing member may be operable to accelerate the housing with respect to the first and second shafts to impart the impact to the downhole tool string when the latching mechanism permits the relative motion between the housing and the second shaft.

The energy storing member may be operable to store mechanical energy.

The energy storing member may be compressible to store elastic energy.

The energy storing member may be compressible by way of relative motion between the housing and the first shaft.

The energy storing member may be disposed within the housing, and the first shaft may be operable to compress the energy storing member when the first shaft moves with respect to the housing.

The energy storing member may comprise a spring.

The energy storing member may comprise a plurality of Belleville washers.

The downhole tool string may comprise an engagement member operable to engage a downhole valve. In such implementations, among others within the scope of the present disclosure, the impact tool may be operable to impart the impact to the engagement member to operate the downhole valve.

The impact tool may be operable for connection with a stroker tool of the downhole tool string, the stroker tool may be operable to apply a force to the impact tool, and the energy storing member may be operable to store the force applied to the impact tool by the stroker tool. In such implementations, among others within the scope of the present disclosure, the stroker tool may be operable to compress the energy storing member. The impact tool may be connected with the stroker tool via the first shaft. The first shaft may be operable to transmit the force from the stroker tool to the energy storing member. The stroker tool may be operable to apply compression to the impact tool, the energy storing member may be operable to store the compression applied to the impact tool by the stroker tool, and the impact tool may be operable to impart the impact to the downhole tool string in a downhole direction when the latching mechanism permits the relative motion between the housing and the second shaft. The stroker tool may be operable to apply tension to the impact tool, the energy storing member may be operable to store the tension applied to the impact tool by the stroker tool, and the impact tool may be operable to impart the impact to the downhole tool string in an uphole direction when the latching mechanism permits the relative motion between the housing and the second shaft.

The present disclosure also introduces an apparatus comprising a downhole tool string. The downhole tool string comprises an impact tool comprising: a housing; a shaft extending from within at least a portion of the housing, wherein the housing and the shaft are axially movable relative to each other; an energy storing member; and a latching mechanism operable to selectively permit relative motion between the housing and the shaft to release energy stored in the energy storing member to impart an impact to the downhole tool string. The downhole tool string also comprises a stroker tool operable to apply a force to the impact tool to impart energy to the energy storing member.

The latching mechanism may be further operable to limit the relative motion between the housing and the second shaft.

At least a portion of the latching mechanism may be connected with the shaft.

At least a portion of the latching mechanism may be connected with the housing.

The energy storing member may be operable to store mechanical energy.

The energy storing member may be compressible to store elastic energy.

The energy storing member may comprise a spring.

The energy storing member may comprise a plurality of Belleville washers.

The shaft may be a first shaft, the housing may have opposing first and second ends, the first shaft may extend at the first end of the housing, the impact tool may further comprise a second shaft extending from within at least a portion of the housing at the second end of the housing, the housing and the second shaft may be axially movable relative to each other, and the second shaft may be operable to transmit the force from the stroker tool to the energy storing member. The impact tool may be connected with the stroker tool via the second shaft. The energy storing member may be compressible by way of relative motion between the housing and the second shaft. The energy storing member may be disposed within the housing, and the second shaft may be operable to compress the energy storing member when the second shaft moves with respect to the housing. The energy storing member may be operable to accelerate the housing with respect to the first and second shafts to impart the impact to the downhole tool string when the latching mechanism permits the relative motion between the housing and the second shaft.

The downhole tool string may further comprise an engagement member operable to engage a downhole valve, and the impact tool may be operable to impart the impact to the engagement member to operate the downhole valve. The engagement member may be connected with the impact tool downhole from the impact tool.

The stroker tool may be operable to compress the energy storing member.

The stroker tool may be operable to apply compression to the impact tool, the energy storing member may be operable to store the compression applied to the impact tool by the stroker tool, and the impact tool may be operable to impart the impact to the downhole tool string in a downhole direction when the latching mechanism permits the relative motion between the housing and the second shaft.

The stroker tool may be operable to apply tension to the impact tool, the energy storing member may be operable to store the tension applied to the impact tool by the stroker tool, and the impact tool may be operable to impart the impact to the downhole tool string in an uphole direction when the latching mechanism permits the relative motion between the housing and the second shaft.

The present disclosure also introduces a method comprising: conveying a tool string within a wellbore, wherein the tool string comprises a stroker tool and an impact tool; operating the stroker tool to apply a force to the impact tool, thereby imparting energy stored by the impact tool; and operating the impact tool to release the energy stored in the impact tool to impart an impact to the tool string.

Operating the stroker tool may comprise extending the stroker tool to apply compression to the impact tool to impart the energy to the impact tool, and operating the impact tool may comprise releasing the energy stored in the impact tool to impart the impact to the tool string in a downhole direction.

Operating the stroker tool may comprise retracting the stroker tool to apply tension to the impact tool to impart the energy to the impact tool, and operating the impact tool may comprise releasing the energy stored in the impact tool to impart the impact to the tool string in an uphole direction.

The impact tool may comprise: a housing; a shaft extending within at least a portion of the housing, wherein the housing and the shaft are axially movable relative to each other; an energy storing member; and a latching mechanism operable to selectively limit the relative motion between the housing and the second shaft. In such implementations, among others within the scope of the present disclosure, operating the stroker tool may comprise applying the force to the impact tool to impart energy to the energy storing member. Operating the stroker tool may further comprise compressing the energy storing member to impart mechanical energy to the energy storing member. Operating the impact tool may comprise operating the latching mechanism to permit relative motion between the housing and the shaft. The shaft may be a first shaft, the housing may have a first end and a second end, the first shaft may extend at the first end of the housing, the impact tool may further comprise a second shaft extending within at least a portion of the housing at the second end of the housing, the housing and the second shaft may be axially movable relative to each other, and operating the stroker tool may comprise applying the force to the impact tool to cause relative motion between the housing and the second shaft to compress the energy storing member to impart energy to the energy storing member. Operating the impact tool may further comprise operating the latching mechanism to permit the energy storing member to accelerate the housing with respect to the first and second shafts to impart the impact to the tool string.

The tool string may further comprise an engagement member, and the method may further comprise, before operating the stroker tool and the impact tool, engaging a downhole valve with the engagement member. In such implementations, among others within the scope of the present disclosure, operating the impact tool may further comprise imparting the impact to the engagement member to operate the downhole valve. Operating the downhole valve may comprise shifting at least a portion of the downhole valve in one of an uphole direction and a downhole direction.

The method may further comprise setting the impact tool to release the energy stored in the impact tool when a predetermined force is being applied to the impact tool by the stroker tool.

The foregoing outlines features of several embodiments so that a person having ordinary skill in the art may better understand the aspects of the present disclosure. A person having ordinary skill in the art should appreciate that they may readily use the present disclosure as a basis for designing or modifying other processes and structures for carrying out the same purposes and/or achieving the same advantages of the embodiments introduced herein. A person having ordinary skill in the art should also realize that such equivalent constructions do not depart from the scope of the present disclosure, and that they may make various changes, substitutions and alterations herein without departing from the spirit and scope of the present disclosure.

The Abstract at the end of this disclosure is provided to allow the reader to quickly ascertain the nature of the technical disclosure. It is submitted with the understanding that it will not be used to interpret or limit the scope or meaning of the claims.

What is claimed is:

1. An apparatus comprising:

an impact tool configured to be connected to a stroker tool, conveyed within a wellbore, and impart an impact to a well tool disposed within the wellbore, wherein the impact tool comprises:

a housing having opposing first and second ends;

an energy storing member disposed within the housing;

a first shaft extending out from the first end of the housing, wherein the first shaft is axially movable with respect to the housing by the stroker tool to transfer mechanical energy to the energy storing member;

a second shaft extending out from the second end of the housing, wherein the second shaft is connectable with the well tool; and a latching mechanism comprising:

a plurality of flexible members disposed within the housing and each comprising a first latching profile, wherein the flexible members are connected with the second shaft;

a third shaft disposed within the housing and comprising a second latching profile; and a biasing member disposed between the third shaft and the housing, wherein the biasing member biases the third shaft to a predetermined position with respect to the housing, and wherein the first latching profiles and the second latching profile are configured to:

engage to limit motion of the housing with respect to the second shaft; and disengage to permit motion of the housing with respect to the second shaft and thus permit the energy storing member to accelerate the housing to impart the impact to the well tool.

2. The apparatus of claim 1 wherein an end of the first shaft is disposed within the housing adjacent to the energy storing member, and wherein the first shaft is operable to elastically compress the energy storing member to transfer the mechanical energy to the energy storing member when the first shaft is moved with respect to the housing by the stroker tool.

3. The apparatus of claim 1 wherein each of the first latching profiles are internal profiles and the second latching profile is an external profile.

4. The apparatus of claim 1 wherein the housing comprises a narrowed inner diameter section preventing the first latching profiles and the second latching profile from disengaging when the first latching profiles and the second latching profile are disposed within the narrowed inner diameter section.

5. The apparatus of claim 1 wherein the energy storing member is or comprises one or more springs.

6. An apparatus comprising:

an impact tool for operation in conjunction with a stroker tool within a wellbore to impart an uphole-directed impact and a downhole-directed impact to a well tool disposed in the wellbore, wherein the impact tool comprises:

a housing having opposing first and second ends;

a first energy storing member disposed within the housing;

a second energy storing member disposed within the housing;

a first shaft extending out from the first end of the housing, wherein the first shaft is axially movable by the stroker tool in downhole and uphole directions with respect to the housing to transfer mechanical energy to the first and second energy storing members, respectively;

a second shaft extending out from the second end of the housing, wherein the second shaft is connectable with the well tool; and a latching mechanism operable to:

limit motion of the housing with respect to the second shaft;

permit motion of the housing in the downhole direction with respect to the second shaft to permit the first energy storing member to accelerate the housing in the downhole direction to impart the downhole-directed impact to the well tool; and permit motion of the housing in the uphole direction with respect to the second shaft to permit the second energy storing member to accelerate the housing in the uphole direction to impart the uphole-directed impact to the well tool.

7. The apparatus of claim 6 wherein the first shaft comprises a larger diameter section disposed within the housing, and wherein the larger diameter section is disposed adjacent to and between the first and second energy storing members.

8. The apparatus of claim 6 wherein a portion of the first shaft is disposed within the housing adjacent to the first and second energy storing members, and wherein the first shaft is operable to:

elastically compress the first energy storing member to transfer the mechanical energy to the first energy storing member when the first shaft is moved by the stroker tool in the downhole direction with respect to the housing; and elastically compress the second energy storing member to transfer the mechanical energy to the second energy storing member when the first shaft is moved by the stroker tool in the uphole direction with respect to the housing.

9. The apparatus of claim 6 wherein the latching mechanism comprises:

a plurality of flexible members disposed within the housing and each comprising a first latching profile; and a third shaft disposed within the housing and comprising a second latching profile, wherein the first latching profiles and the second latching profile are configured to:

engage to limit motion of the housing with respect to the second shaft; and disengage to permit motion of the housing with respect to the second shaft.

10. The apparatus of claim 9 wherein:

a first feature is connected with the second shaft;

a second feature is disposed in a predetermined position within the housing;

the first feature is either the third shaft or the plurality of flexible members; and the second feature is the other of the third shaft and the plurality of flexible members.

11. The apparatus of claim 10 wherein the second feature is disposed in the predetermined position within the housing via opposing biasing members each operable to bias the second feature in an opposing direction.

12. The apparatus of claim 11 wherein the first feature is the plurality of flexible members, and second feature is the third shaft.

13. The apparatus of claim 6 wherein each of the first and second energy storing members is or comprises one or more springs.

14. A method comprising:

conveying an impact tool within a wellbore, wherein the impact tool comprises:

a housing having opposing first and second ends;

a first energy storing member disposed within the housing;

a second energy storing member disposed within the housing;

a first shaft extending out from the first end of the housing; and a second shaft extending out from the second end of the housing;

connecting the second shaft to a well tool disposed in the wellbore;

operating a stroker tool connected above the impact tool to impart a downhole-directed force to the first shaft to move the first shaft in a downhole direction with respect to the housing thereby elastically compressing the first energy storing member;

operating the impact tool to permit the first energy storing member to accelerate the housing in the downhole direction with respect to the second shaft to impart a downhole-directed impact to the well tool;

operating the stroker tool to impart an uphole-directed force to the first shaft to move the first shaft in an uphole direction with respect to the housing thereby elastically compressing the second energy storing member; and operating the impact tool to permit the second energy storing member to accelerate the housing in the uphole direction with respect to the second shaft to impart an uphole-directed impact to the well tool.

15. The method of claim 14 wherein the shaft comprises a larger diameter section disposed within the housing, and wherein the larger diameter section is disposed adjacent to and between the first and second energy storing members.

16. The method of claim 14 wherein at least one of the downhole- and uphole-directed impacts:

operates the well tool; or dislodges the well tool stuck within the wellbore.

17. The apparatus of claim 6 wherein the latching mechanism comprises:

a plurality of flexible members disposed within the housing and each comprising a first latching profile, wherein the flexible members are connected with the second shaft; and a third shaft disposed within the housing and comprising a second latching profile; and a biasing member disposed between the third shaft and the housing, wherein the biasing member biases the third shaft to a predetermined position with respect to the housing, and wherein the first latching profiles and the second latching profile are configured to:

engage to limit motion of the housing with respect to the second shaft; and disengage to permit motion of the housing with respect to the second shaft and thus permit the energy storing member to:

accelerate the housing in the downhole direction to impart the downhole-directed impact to the well tool via the second shaft; and accelerate the housing in the uphole direction to impart the uphole-directed impact to the well tool via the second shaft.

18. The method of claim 14 wherein a portion of the first shaft is disposed within the housing adjacent to and between the first and second energy storing members.

19. The method of claim 14 wherein each of the first and second energy storing members is or comprises one or more springs.

20. The method of claim 14 wherein:

the impact tool further comprises a latching mechanism comprising:

a plurality of flexible members disposed within the housing and each comprising a first latching profile, wherein the flexible members are connected with the second shaft;

a third shaft disposed within the housing and comprising a second latching profile; and a biasing member disposed between the third shaft and the housing, wherein the biasing member biases the third shaft to a predetermined position with respect to the housing;

the method further comprises engaging the first and second latching profiles to limit motion of the housing with respect to the second shaft;

operating the impact tool to permit the first energy storing member to accelerate the housing in the downhole direction with respect to the second shaft comprises disengaging the first and second latching profiles to permit the first energy storing member to accelerate the housing in the downhole direction with respect to the second shaft; and operating the impact tool to permit the second energy storing member to accelerate the housing in the uphole direction with respect to the second shaft comprises disengaging the first and second latching profiles to permit the second energy storing member to accelerate the housing in the uphole direction with respect to the second shaft.

* * * * *